US006811655B1

(12) United States Patent
Haffner

(10) Patent No.: US 6,811,655 B1
(45) Date of Patent: Nov. 2, 2004

(54) APPARATUS FOR PREPARING PAPER PULP FROM USED PAPER

(75) Inventor: Eric Haffner, Lisbon (PT)

(73) Assignee: Finidro-Financiamentos Energeticos, Lda., Lisbon (PT)

( * ) Notice: Subject to any disclaimer, the term of this patent is extended or adjusted under 35 U.S.C. 154(b) by 0 days.

(21) Appl. No.: 09/980,687

(22) PCT Filed: Jun. 8, 2000

(86) PCT No.: PCT/PT00/00006

§ 371 (c)(1),
(2), (4) Date: Aug. 21, 2002

(87) PCT Pub. No.: WO00/75422

PCT Pub. Date: Dec. 14, 2000

(30) Foreign Application Priority Data

Jun. 9, 1999 (PT) ..... 102320

(51) Int. Cl.[7] ..... B03B 1/00; B01B 3/00

(52) U.S. Cl. ..... 162/261; 209/724; 209/725; 209/172.5; 209/199; 209/713; 210/512.2; 210/512.3; 210/787; 210/789; 241/24.1; 241/24.11; 241/24.19; 241/27; 241/28; 241/29; 241/68; 241/69

(58) Field of Search ..... 162/261; 209/210, 209/211, 172, 199, 144; 210/512.1, 512.3, 787, 789; 55/409; 241/24.29, 27, 28, 68, 79

(56) References Cited

U.S. PATENT DOCUMENTS 4,443,331 A * 4/1984 Amand ..... 209/211
4,533,468 A * 8/1985 Ensor et al. ..... 209/172
5,131,544 A * 7/1992 Serres et al. ..... 209/210
5,257,698 A * 11/1993 Christ et al. ..... 209/210

FOREIGN PATENT DOCUMENTS

DE 29 24 794 B 3/1980

* cited by examiner

*Primary Examiner*—Steve Alvo
(74) *Attorney, Agent, or Firm*—Birch, Stewart, Kolasch & Birch, LLP

(57) ABSTRACT

The invention concerns a method and an equipment for combining in one single apparatus, the functions for filtering, decontaminating, and thickening paper pulp from used paper, while providing the complementary function of clarifying the filtrates. The apparatus (1) rotates at high speed. The paper pulp is introduced through the center of the apparatus (2) and driven at its angular speed. The pulp is then brought along a grate (6) with small size holes for separating the fibers from the greater part of the water. The thickened pulp is evacuated through extraction nozzles (8). The water is clarified in the clarification zone (12) and recycled or eliminated depending on uses. More complete embodiments of the apparatus include the functions of fractionating, de-inking and purifying the pulp with slots or holes.

19 Claims, 6 Drawing Sheets

APPARATUS FOR PREPARING PAPER PULP FROM USED PAPER

This application is the national phase under 35 U.S.C. § 371 of PCT International Application No. PCT/PT00/00006 which has an International filing date of Jun. 8, 2000, which designated the United States of America.

The present invention concerns the domain of the paper industry and more specifically the preparation of pulp from recycling used papers to produce paper.

For the manufacture of pulp from used paper, it is necessary to put the cellulose fibres in suspension and discard the undesirable foreign components, called contaminants, being this operation called decontamination. The contaminants can have miscellaneous shapes. In particular, metallic particles (clips), sand and gravel, adhesive materials, bits of plastic, . . . are found.

Inks are also found, which will be important to remove for some productions, namely for papers called <<white>> aimed to be printed, to be handwritten or for sanitary use (<<tissue>>).

In addition to the above-mentioned contaminants, mineral matter is also found, blended to the paper in some manufactures (magazines, paper for printing, handwriting . . . ). The presence of mineral matter can be undesirable, in particular for the production of sanitary papers. In such cases their separation from the pulp is necessary.

The preparation of pulp using used paper is the global method, going from disintegration of the used paper until the different stages of decontamination, eventually the elimination of inks (de-inking) and the mineral matter (washing) and may include one or two whitening stages allowing the fibres to recover their initial whiteness. The obtained pulp will be used to feed the paper production apparatus.

The preparation of pulp for packing cardboards is much less demanding in terms of decontamination.

The classic method of pulp preparation from used paper always begins with the disintegration of the paper and the suspension of fibres, using a pulping apparatus (Stage A). The pulping apparatus is an equipment provided with a rotor (or turbine), which causes a sufficiently strong stirring to the used paper, blended with water, that the connections between the fibres (hydrogen bonds) are broken one after another. A paper pulp from used paper is thus obtained.

According to the quality of the final pulp to be obtained, the following stages may be followed:

Stage B: A coarse decontamination. The coarser components and in particular the plastic materials, are eliminated by passage through a grate.

Stage C: The elimination, by hydrocyclone, of the heavy coarse particles like coarse sands, bits of glass, and metallic particles such as clips.

Stage D: The elimination of the small plastics and other contaminants of intermediate size by the passage through a grate (or grate depuration) in two or three steps, consisting in passing the pulp through small holes (between 1 and 3 mm) and retaining the contaminants of size higher than the holes.

Stage E: The elimination of small contaminants, essentially of granular aspect (by opposition to plate contaminants) by a slot depuration (between 0.1 and 0.3 mm), working based in the same principle as the hole depuration. The holes are replaced by slots, which the fibres, taking into account their low diameter, are able to pass through.

Stage F: For the so-called <<white>> paper, the elimination of inks by one or several cells of flotation. Inks are separated with the help of small air bubbles eventually with the help of a soap or a surfactant.

Stage G: The elimination of the fine sands and coarse black points (small heavy contaminants) by batteries of several stages of hydrocyclones.

Stage H: In some cases, the elimination of small contaminants of density lower than 1 by a hydrocyclone.

Stage I: More particularly applicable to tissue paper, the elimination of the mineral matter by washing the pulp. The greater part of the water is evacuated, taking with it the major part of the loads.

Stage J: Thickening of the pulp, to facilitate its storage before reaching the paper apparatus or preparing the pulp by a hot dispersion or a refining.

Stage K: In some cases, dispersion of the residual contaminants, by one dispersant or grinder, in order to make these contaminants non visible by the eye. In other cases, modification of the pulp mechanical properties by one refiner.

In many cases, redilution and repeating one or more of the previous described stages is performed. It will then be called a second loop, or even a third loop, if after the second loop one or several stages are again repeated.

Stage L: Clarification of the filtrates by one microflotation device using dissolved air. The suspended matter is collected in flocks and then flotated at the surface with the help of air microbubbles and polymers (flocculants and coagulants).

Stage M: Thickening of the solid matters extracted in Stage L.

Stage N: Treatment of the residual waters by a depuration station.

Stage O: Whitening of the fibres for certain uses.

The presently used methods of pulp preparation are a more or less complete combination of the above-mentioned stages, each one performed by one different equipment. Between each stage, the pulp is generally pumped, causing a high energy consumption. Certain stages need the use of chemical products. It is frequent, particularly when the production of <<white>> paper is wanted, to impose restrictive optical criteria, and then the method of recycling used paper is not competitive in comparison with the utilisation of virgin cellulose.

The invention has the object of replacing itself, in its base version, to several equipments corresponding to the above-mentioned Stages H, J, L, M, or even C, D, E, F, G and I, whatever may be the type of paper to be produced, allowing also an important economy of energy and chemical products. The recycling of the used paper will then be more competitive, including when aimed to more exigent applications. The invention also allows a very lower land investment.

BRIEF DESCRIPTION OF THE DRAWINGS

The invention is represented by 6 drawings, corresponding to the main uses and showing the main variants disclosed in the description. Their numbering corresponds to the references appearing in the text. All drawings are presented as merely indicative and without any limitative intention.

FIG. 1 represents a section of an embodiment of the invention more particularly applicable to sanitary papers (called <<tissue>>) in its base configuration having, besides the base functions, one device for the recovery of the fibres having passed through the grate (6) and their recovery by the tube (14) at the centre of the device, one clarification device in two stages, and one device for the reintegration of the recovered elements (13).

FIG. 2 represents a section of an embodiment of the invention more particularly applicable to sanitary papers having besides the base functions: one previous treatment of the pulp by elimination of the fine sands and other <<heavy>> or <<light>> contaminants in the sedimentation chamber (25) and one classification by slots; one device for the recovery of fibres having passed through the grate (6) and their concentration in the chamber (33); one device for the reintegration of the recovered elements (13).

FIG. 3 represents a section of an embodiment of the invention more particularly applicable to printing and handwriting paper and paper for newspapers and magazines, having, besides the base functions: one previous treatment of the pulp by elimination of the fine sands and other <<heavy>> or <<light>> contaminants in the sedimentation chamber (25) and one classification by slots; one pre-clarification device in the chamber (33); one device for the reintegration of the recovered elements (13).

FIG. 4 represents a section of an embodiment of the invention more particularly applicable to cardboard and packaging papers, having, besides the base functions: one previous treatment of the pulp by elimination of the fine sands and other <<heavy>> or <<light>> contaminants in the sedimentation chamber (25) and one classification by slots; one pre-clarification device in the chamber (33); one device for the reintegration of the elements extracted during the clarification of the pulp by deflectors (39).

FIG. 5 represents a section of a classifier grate having holes/slots.

FIG. 6 corresponds to the speed-slowing device of the fibres extracted at the periphery (8) by tubes having the shape of a snail.

For sanitary papers, called <<tissue>>, the invention consists, in its base version, in regrouping the functions of washing, de-inking, elimination of the particles of density lower than 1, fibre thickening, thickening of the suspended matter from the filtered matter, clarification of water and elimination of contaminants having a density lower than 1. The invention therefore replaces itself to the apparatus corresponding to stages F, H, I, J, L, M of the classic method of paper pulp preparation. FIGS. 1 and 2 represent, in particular, two embodiments of the invention applicable to this paper quality.

For printing and handwriting papers and papers for newspapers and magazines, the present invention consists in regrouping, in its base version, the functions of de-inking, fibre thickening, clarification of water and elimination of the contaminants of density lower than to 1. The invention regroups stages F, H, J, L, M and eventually I of the classic method of paper pulp preparation. FIG. 3 represents, in particular, a embodiment of the invention for this application.

For the production of paper and packaging cardboard, utilising more particularly non-whitened fibres, the present invention consists in regrouping, in its base version, the functions of fibre thickening, clarification of water and elimination of contaminants with density lower than 1, and eventually the fractioning of the long/short fibres. The invention replaces stages H, J, L, M of the classic method of paper pulp preparation. FIG. 4 is an embodiment of the invention for this application.

Figure 1:
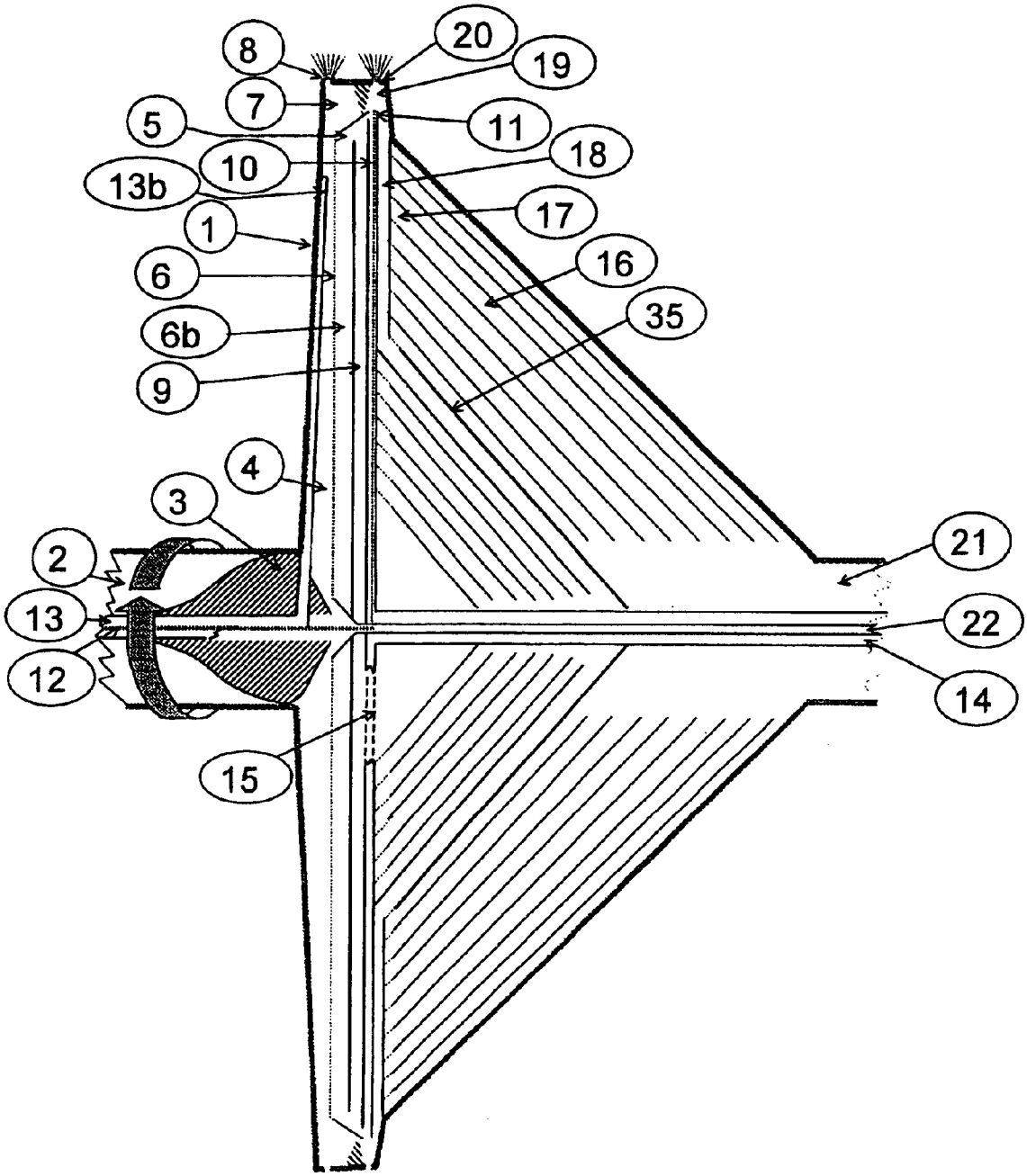
FIGS. 1 to 4 represent several embodiments of the invention, corresponding to several uses.

In a more complete version for any applications, the invention replaces stages C to E and G of the classic method of paper pulp preparation.

The proposed apparatus comprises a body (1) rotating at a high speed and driving with itself all internal constituents of the device. The body of the device is acted by one engine not represented in the figures.

In the past, used papers had to be disintegrated by means of a pulpier (Stage A), and be submitted to a coarse decontamination (Stage B). In its base version (FIG. 1) the pulp should still be submitted to Stages C, D and E of the classical method before the introduction in the apparatus.

The pulp thus previously treated and free from the more important contaminants is introduced along the axis of the apparatus, by one central pipe (2). The blades (3) allow the pulp to be driven in rotation at the same angular speed as the apparatus. All inlet and outlet pipes (2), (12), (13), (14), (21), (22) and (37) are connected to mechanical joints, not represented in the figures, ensuring a sealed connexion with the fixed pipes. The rotation speed of the device is such that the particles are submitted at its periphery to an artificial gravity field, which may be higher than 1000 times the earth gravity.

In the base versions (FIG. 1), the pulp has already been submitted to stages A to E of the classical method and only contains small contaminants (having in general a diameter less than 0.5 mm). The pulp to be treated is taken (4) along a grate with small holes (6), the majority of water passing through the grate while the fibres are retained due to the low diameter of the holes. The fibres are driven, due to their density higher than 1, and under the effect of the artificial gravity field created by the apparatus rotation, to the apparatus periphery and lead the pulp into the concentration chamber (7). This action finishes at the extraction nozzles (8) with permanent or sequential aperture allowing the pulp to be extracted at an optimal concentration.

Figure 6:
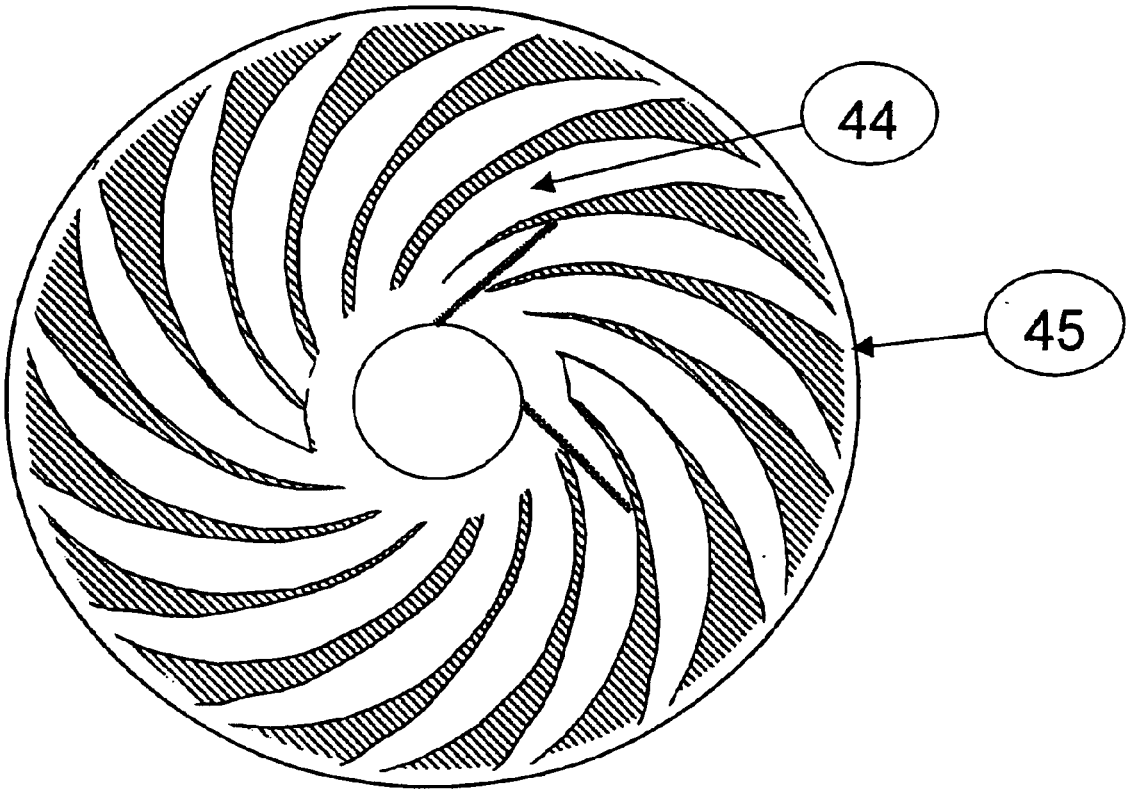

In order to not damaging the fibres, the extraction being done at high speed, the speed reduction of the pulp may be ensured by circular tubes (44) placed in a disposition having the shape of a snail (FIG. 6). The extracted pulp at the periphery of the apparatus reaches the deceleration rings whose dimensions are determined depending the acceptable maximum speed.

The contaminants of density lower than 1 not passing through the grate (6) migrate to the axis of the apparatus by the action of the artificial gravity field created by the apparatus rotation, where they are collected and evacuated by a pipe (22).

The filtrates and water, having passed through the holes of the grate (6), are moved to the different treatments according to the uses.

For the version more particularly aimed to <<tissue>> uses (FIGS. 1 and 2), one of the objectives of the invention is to recover the fibres and fines (fragments of fibres) having passed through the grate (6). The aim is also to eliminate ink and mineral matter from the water in order to reutilise it and to close at maximum the water circuits and to reduce the fresh water consumption. The non-clarified waters are, firstly, treated immediately their passage through the grate. The aim is to recover the fibres, which contain also the heavier and coarser elements of the filtrates in question.

In order to recover the fibres having passed through the filtration grate (6), 2 different solutions are provided. The first solution, represented in FIG. 1, consists in leading the cellulosic elements to be recovered to the apparatus axis. The non-clarified water is conducted by the pipe (9). The suction speed of the pipe (9) to the feed zone (15) of the clarification zone (16) is not sufficient to drive the fibres and other heavier particles, that therefore sediment at the periphery of the zone (5). These particles are recovered by a pipe (10) that take them to the apparatus axis. The section of this pipe is designed to allow a flow speed higher than the sedimentation speed of the fibres. At the periphery of the chamber (5), an aperture (11) that communicates with the concentration chamber (19) of the solid elements separated from the waters to be clarified, allows to avoid the formation of sediments. This aperture may be passed by one counter-flow of water fed by a pipe (12). The flow rate of this water will be adapted so that the speed of the flow that passes through the aperture be higher than the fibre sedimentation speed, while the high-density elements, that resist the flow due to their higher sedimentation speed, are collected in the concentration chamber (19) before being extracted by the nozzles (20). The recovered fibres, collected by the pipes (10) and extracted by the centre of the apparatus by the tube (14), are eventually treated by classical means of de-inking before reintegrating the pulp in the apparatus.

Figure 2:
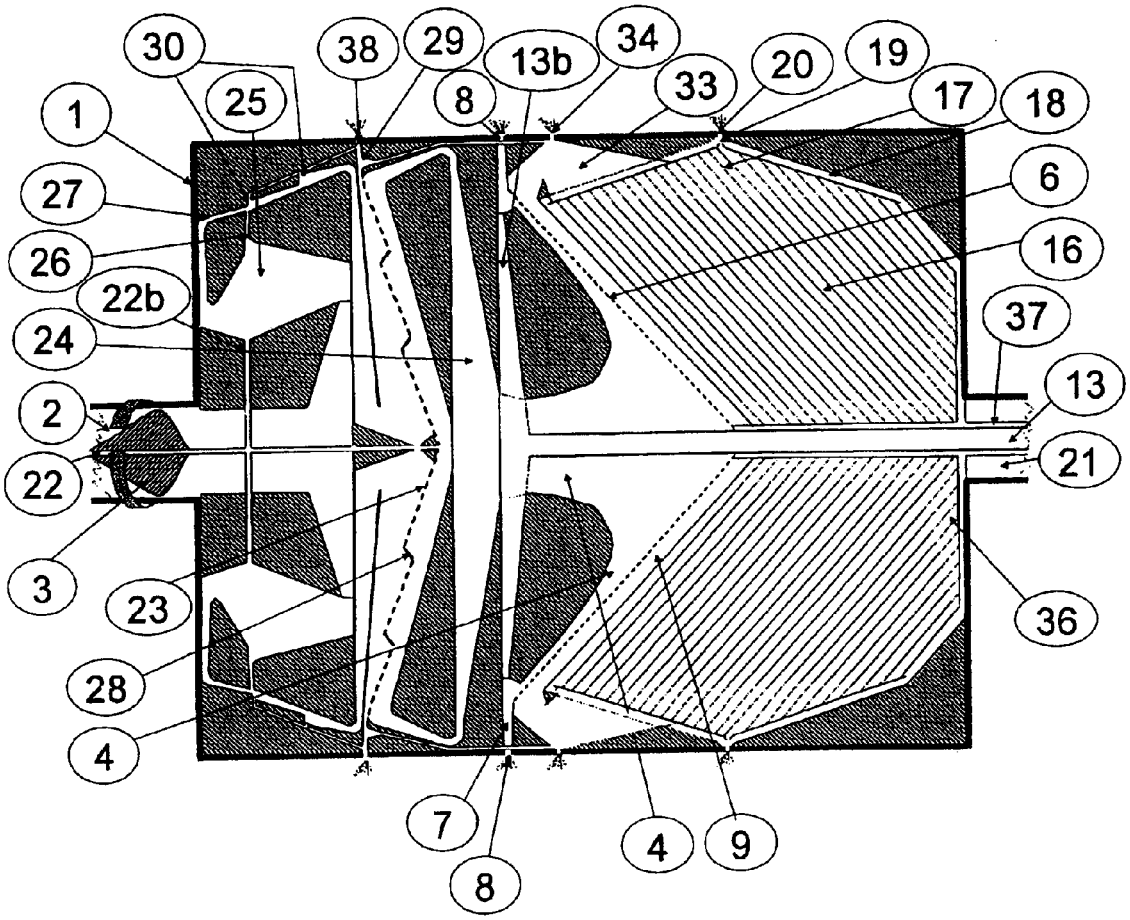

The second solution for the separation of the fibres and their treatment and recovery, consists in extracting them at the periphery of the apparatus. FIG. 2 is a representation of this configuration. The aim is to include a sedimentation zone (33) at the periphery of the zone (9) and downstream the grate (6) where the fibrous elements having sedimented by the effect of the artificial gravity field, created by the fast rotation of the apparatus, are collected. These elements can then be evacuated at the periphery of the apparatus by the nozzles (34). Waters to be clarified go directly from the zone (33) to the clarification zone (16).

The fibres extracted by one of the two considered means are previously treated, if necessary, and may be reintegrated in the apparatus. This reintegration is performed by a pipe (13) that allows the leading of the fibres and other elements to be integrated to the apparatus periphery in the points (13*b*) of introduction in the zone (4). This localisation at the periphery, next to the pulp concentration zone (7), allows limiting the losses in fibres and other reintegrated elements, being the only aim to thick the pulp and reintegrated elements. The filtration grate (6) may have, for diameters higher than the point of reintroduction (13*b*), holes of smaller size in order to limit the passage of the reintegrated elements through the grate.

For other applications (FIGS. 3 and 4), either for printing or handwriting papers or packaging cardboards and papers, the waters separated from the fibres are, for the greater part of these uses, directly connected to the clarification zone by the pipe (9). In effect, the greater part of the solid elements contained in the waters, including loads, and separated in the clarification stage, are reintegrated in the paper pulp after an eventual treatment. This reintegration can be performed according to a method identical to the above-disclosed one.

For other applications, more particularly aimed to the production of certain packaging cardboards and papers needing specific mechanical properties, the grate (6) will also have a fractioning function, i.e. separation between long fibres and short fibres, the long fibres being retained by the grate while the short fibres pass through it. In this configuration, the size of the holes will be designed taking into account the desired effect of fractioning.

For all applications, water and elements having passed through the grate (6) will be collected in the chamber (9) and taken to the clarification zone (16) constituted by cones close to each other, made of plastic or composite matter with a density close to 1. Water to be treated, surrounded by the separation cones, is directed from the periphery to the axis of the apparatus. The particles having a density different from that of water, under the effect of the artificial gravity field, have a radial speed different from the water one and find the surface of the closest separation cone. Due to the friction between water and cones, the speed of water near the cones is very small, and this facilitates the migration of the particles along the conical surfaces. The particles collected by the cones will have a migration speed higher than the water speed in the immediate vicinity of the cones. Once they meet one cone, the particles of density higher than 1 will then rise progressively along the face of the cone. Water passes to the centre of the device where it is evacuated by the tube (21).

The extremity at the periphery of each cone can be prolonged by evacuation channels (17) that allow the solids collected by the cones to continue their way to the periphery together with the non-clarified water flow at the admission of the clarification. These channels, represented in FIG. 2, communicate themselves with the pipe for the evacuation of solids (18) before joining the concentration chamber (19) and being expelled from the apparatus by the nozzles (20). These nozzles (20) have an aperture permanent or sequential according to the case and the uses.

A similar method will be utilised to separate and eliminate to the axis of the apparatus, by the action of the artificial gravity field, the contaminants of density lower than 1 that migrate to the centre of the apparatus where they are collected by the pipe (37). In this case, the cones of the clarification zone (16) may be prolonged by the channels (36). This application is represented in FIG. 2.

Figure 3:
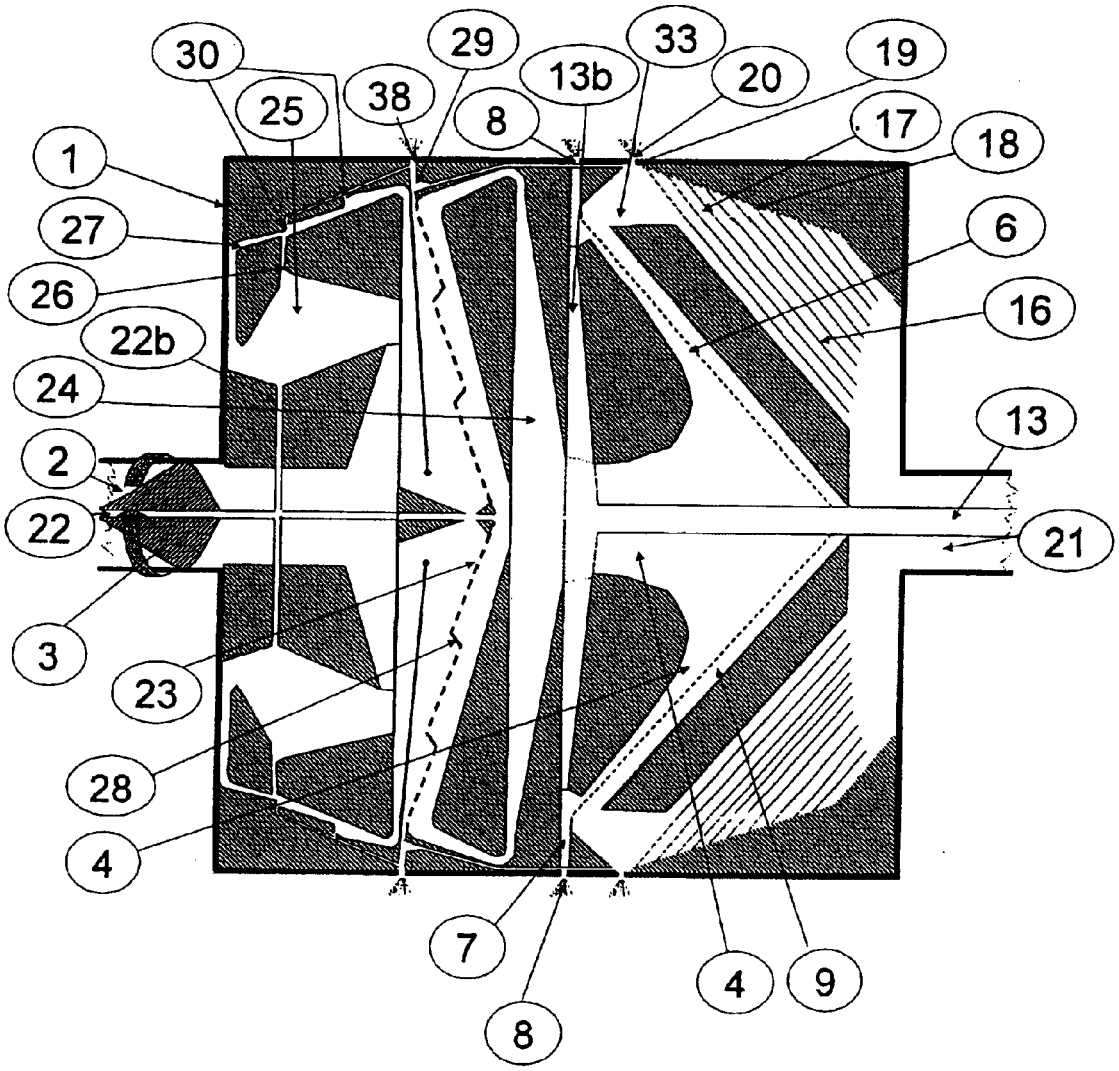
Figure 4:
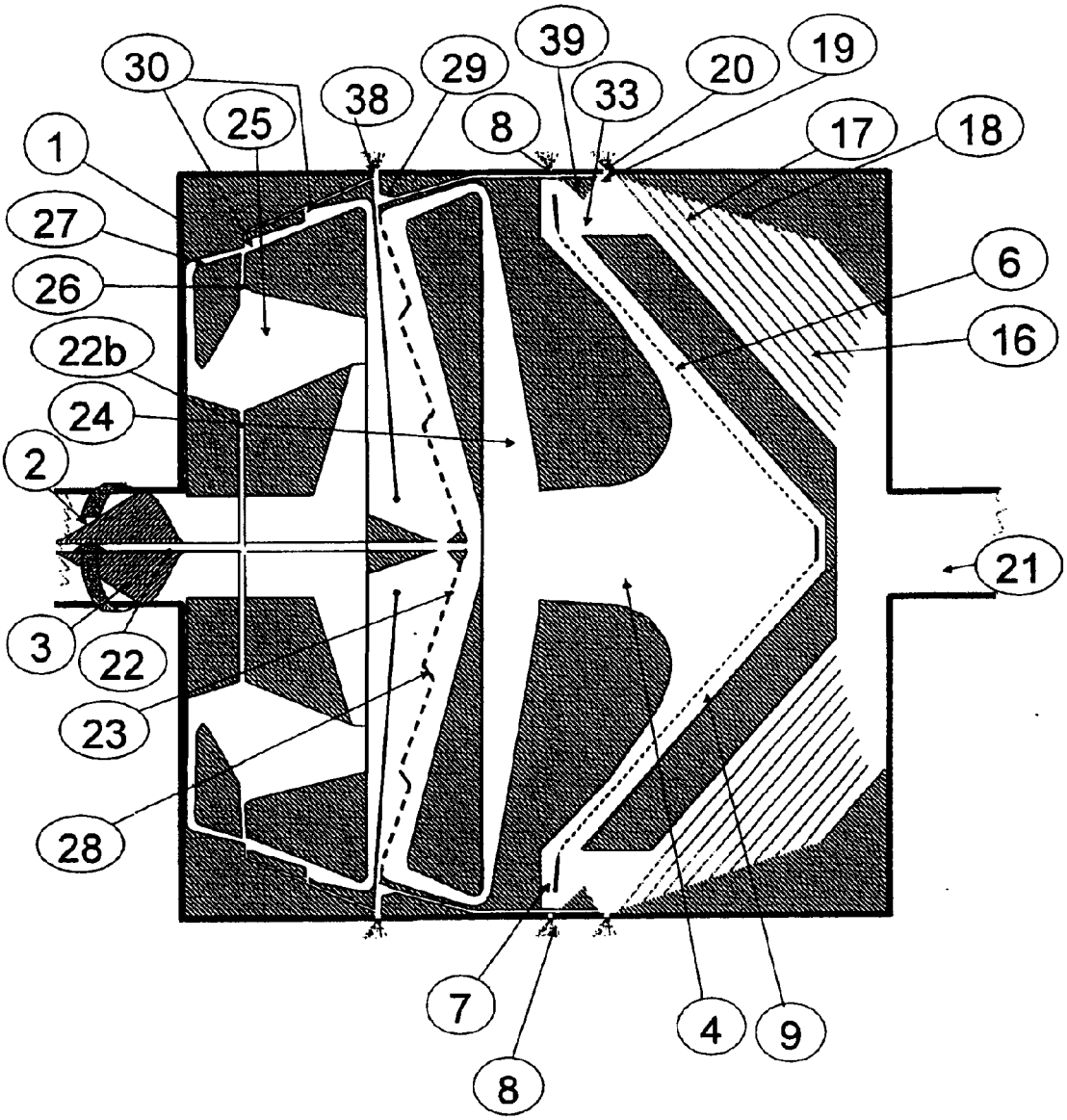
Figure 5:
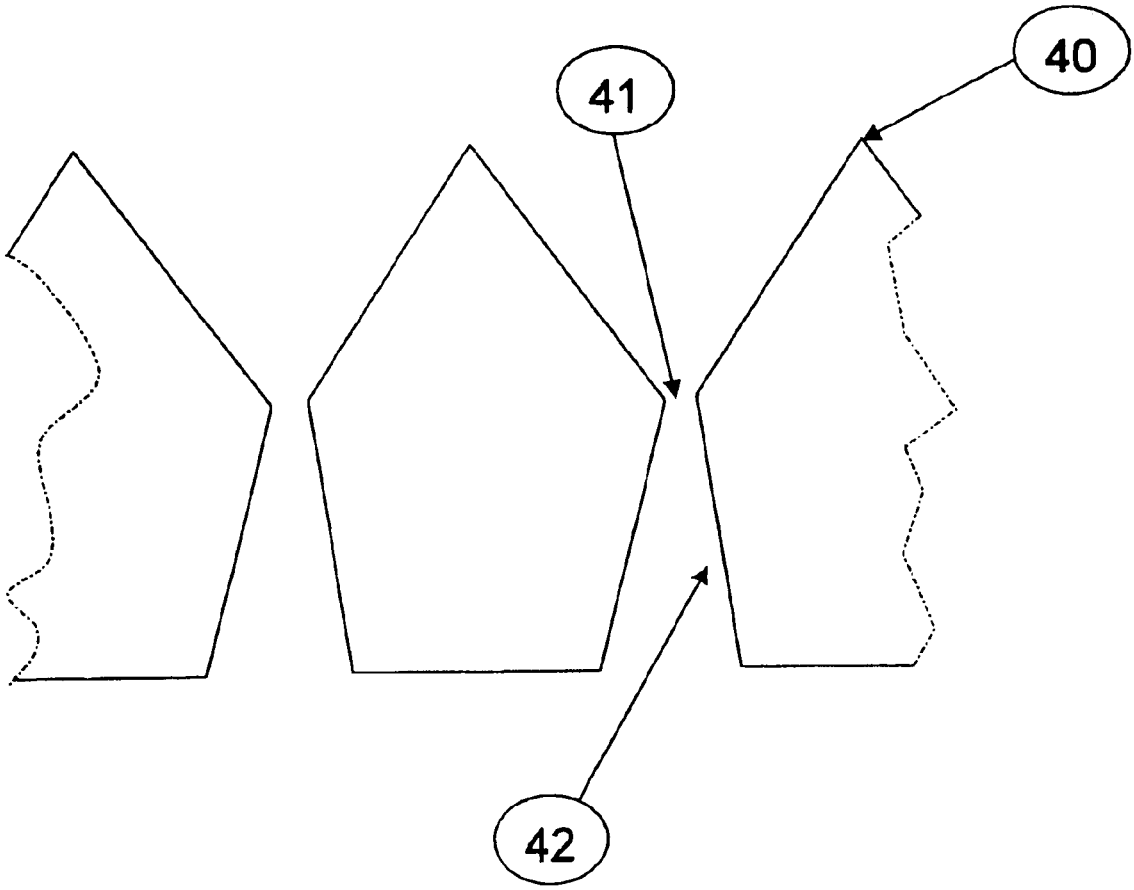
FIGS. 5 and 6 represent the details and specific parts of the invention.

In order to improve the quality of the water clarification and avoid a saturation of the circuits in mineral matter and other colloids linked to an effect of clogging, particularly damaging to certain qualities of papers, the invention apparatus can be provided with a clarification in 2 steps, where the water passes successively in a preclarification zone (33) and then in a final clarification zone (16), the two zones working in series. In FIGS. 2, 3 and 4 this application is represented. The objective of the preclarification zone (33) is to eliminate the more important particles, which in their displacement are susceptible to create a micro-turbulence that disturbs the sedimentation of the finer particles. The zone of final clarification (16), with very close plates of separation, allows sedimentation of the finer elements according to the principle already presented. Elements that are separated during the preclarification by sedimentation in the chamber (33) are taken to the periphery of the apparatus where they are evacuated at the periphery of the apparatus.

Another solution to obtain a preclarification and a final clarification is the division of the clarification zone (16) in two sub-zones, both equipped with separation cones, separated by an intermediate wall (35), that allows, once the preclarification is finished, to drive the water to the final clarification. In FIG. 1 this solution is represented.

For some uses, and in particular those aimed to the production of sanitary papers <<tissue>> (FIGS. 1 and 2), the solids that exit the clarification zone and are ejected by the nozzles (20) are not recovered by the paper fabrication method, being the majority of the mineral matter incompatible with the fabrication of <<tissue>> papers.

On the contrary, for the major part of the uses in papers for printing and handwriting, and papers/cardboards for packaging (FIGS. 3 and 4), at least a part of these solids will be reintegrated in the pulp.

For use in paper for printing and handwriting (FIG. 3), the solids extracted during the clarification will be extracted by the nozzles (20). It will be eventually needed to treat these particles to remove ink and solids by conventional means (selective flotation) before, eventually, the reintegration by means of the above-mentioned pipe (13).

For some uses, the invention allows to reintegrate directly in the pulp all or part of the elements having been separated during the clarification step. FIG. 4 illustrates such use. Inclined deflectors (39) allow deriving a part of the elements having sedimented in the sedimentation chamber (33) to the pulp concentration chamber (7). The aperture of these deflectors (39) may be fixed or adjustable in order to allow the mixture in the desired proportions of the fibres and the reintegrated elements, in particular the loads.

A more complete description of the invention, represented in FIGS. 2, 3 and 4, will comprise the function described by Stage G, i.e. the elimination of fine sands as well as several contaminants. The pulp is introduced in a chamber (25). The contaminants of density lower than 1 are driven to the axis of the apparatus and are evacuated by openings (22*b*) connected to the tube (22). The other solid elements, including fibres, of density higher than 1, sediment at the periphery of the apparatus where they are collected by openings (26) located at the periphery of the chamber (25) and taken by pipes (27) to the following phase of the method. The pipe (27) is provided with openings allowing the separation and the extraction of the contaminants of density higher than 1 that have a speed of sedimentation higher than that of the fibres. These elements sediment and are separated by the openings (30) and extracted from the apparatus by the nozzles (38). The pipe (27) will have an inclination and section adapted to avoid the sedimentation of the fibres and the passage of these ones in the openings (30). To increase the horizontal speed of the fibres and to limit the risk of sedimentation, the pipe (27) will be fed by the water extracted in the central part of the chamber (25).

Whatever the uses may be, a more complete version of the invention consists in adding one classification by slots and/or holes. The aim is then to perform Stages B to E of the classical method. This classification is performed by a grate preferably with a conical shape (23). The grate (23) will be placed upstream of the grate (6) (FIGS. 2, 3 and 4). The pulp is introduced at the axis of the device at the periphery of the grate (23) according to a principle identical to the filtration grate (6). The fibres pass through the slots (or holes), taking into account their small diameter, while some contaminants are retained.

The contaminants of high dimensions (which do not pass through the grate) and have a density higher than 1 sediment and concentrate at the periphery of the apparatus where they are extracted by several extraction nozzles (38). The contaminants of density lower than 1 will migrate to the axis of the device and will be extracted by a central pipe (22). However, the presence of a separation chamber (25), upstream, comprising already a stage of elimination of the light contaminants may be useless for many uses. The elimination of the light contaminants will be made at the centre of the device. Counterwashing cycles, allowing limiting the clogging of the grate, will be then sufficient to avoid the sedimentation of the lighter contaminants in the central part of the apparatus.

Water having passed through the slots (23), driving with it the fibres in suspension, is conducted to the axis of the apparatus by one pipe (24) to the zone (4), whose section is designed to impose a speed sufficient to the fluid to avoid a too fast sedimentation of the fibres to the periphery of the device.

In the case of using very contaminated used papers, it is possible to provide a complementary removal of sands and the elimination of some contaminants or inks having passed through the grate (23). In such a configuration, an aperture (not represented) at the part most in periphery of the pipe (24) will allow the evacuation of the heavier elements by sedimentation. This aperture may be passed by one counterflow of clear water whose flow rate would be adjusted so that the speed of this counterflow be higher than the speed of sedimentation of the longer fibres and lower than the corresponding to the contaminants to be separated.

In a more complete version, not represented in the figures, it will be possible to add a grate provided with holes before the grate with slots (23), and working exactly according to the same principle. The holes allow a complementary decontamination helping the decontamination with slots. After finishing the stage of decontamination with holes, the pulp is introduced in the base of the grate with slots (23) according to the above-described method.

It must be noted that the combined action of the foreseen separation in the chamber (25) and of the grate with slots (23) will satisfy the majority of the uses by producing a pulp of quality sufficient for not needing the passage through a grate with holes such as the one described in the previous paragraph.

The grate with slots has the inconvenient of constituting a capacity limitation of the apparatus. The open surface of the grate may be very small and not allow the passage of the permissible flow for all other functions. To avoid this inconvenient, it is possible to create at the outside of the grate one or several apertures (29) (represented in the FIGS. 2, 3 and 4) allowing to derive an important part of the flow to the clarification zone. The peripheral disposition of these apertures allows limiting the driving of the fibres, since these ones have already passed through the slots (23). The contaminants being at the level of the aperture have a density higher than 1. The objective is to avoid these contaminants to be driven before the water derived by the apertures (29).

To do this, the apertures will be disposed with a small retraction in relation to the length walked by the contaminants on one hand, and will have a funnel shape allowing the eventual contaminants closer to the aperture (29) to sediment at the periphery without being driven by the apertures (29). The derived water will be then directly conducted to the clarification zone. Any contaminant having, in spite of this, passed these pipes will not cause any problem. It will be then possible, by means of addition of a water separation device, not represented in the figures, to drive the derived water by the pipe (29) upstream the filtration grate (6) in order to improve the washing effect.

The classifier grates (23) will have an adapted shape, in order to improve their efficiency. The conical shape of the grate with slots or with holes allows to easy the contact with the fibres and their passage through the grate. The angle of the cone will be designed to facilitate the passage of the fibres. However, this conical shape has also as a consequence the concentration of the contaminants of density higher than 1 in the grate. In order to avoid the clogging of the holes, the grate is provided, for the majority of the uses with material relatively contaminated, with angles <<ladder wise>> (28). FIGS. 2, 3 and 4 represent such a grate (23) with the ladders (28).

The angle allows deviating the contaminants from the grate so that they gain speed before meeting again the grate. This device will facilitate this way their sedimentation at the periphery of the grate. This angle will facilitate, on the other hand, the passage of the fibres by regularly breaking the set of fibres that are formed at the surface of the grate.

The openings have a radial direction. The inlet of the openings is conical (40), and the cones of the adjacent openings will meet, in order that no plane surface between two cones exists. The objective is to concentrate the fibres at the inlet of the openings, and to the direct them parallel to the openings, being the average length of the fibres much higher than the width of the openings. Once the minimum section is reached (41), the section of the openings raises (42) in order to avoid their clogging. FIG. 6 shows two openings in profile with these different dispositions.

What is claimed is:

1. An apparatus for the preparation of paper pulp from used papers previously disintegrated and put in fibrous suspension by a pulper, said apparatus comprising a body (1) rotating at high speed driving together all components inside it, the body (1) comprising:

an inlet pipe (2) for the fibrous suspension located at the centre of the body (1), being the fibrous suspension driven at the angular speed of the body by means of blades (3) solidary with the body (1);

a feeding zone (4) of a filtration grate (6) into which the fibrous suspension introduced in the body (1) of the apparatus is driven, being the grate (6) provided with small holes which allow to retain at least a part of the fibres contained in the suspension while the major part of the water, small contaminants and mineral loads contained in the suspension pass through the grate (6);

a zone (7) for the concentration of the part of the suspension retained by the grate (6) located at the periphery of the feeding zone (4) of the grate (6);

several apertures (8) located at the periphery of the body (1) of the apparatus to evacuate the concentrated suspension from the concentration zone (7); and a clarification chamber (16) to clarify the water having passed through the grate (6), the clarification chamber (16) comprising separation cones to facilitate the separation and migration of solid elements present in the water to be clarified, said clarification chamber also including apertures (20) located at the periphery of the apparatus body (1) for the evacuation of the solid elements having sedimented at the periphery of said chamber (16) and a central pipe (21) for the evacuation of the clarified water; and a preclarification chamber (33), immediately upstream the clarification chamber (16), aimed to separate the coarser solid elements before the final clarification of the water.

2. An apparatus according to claim 1, characterized by the apparatus comprising also one or several tubes (44) bent in a snail shape at the outside of the body (1), whose inlets are located facing the apertures (8) for the evacuation of the concentrated suspension retained by the filtration grate (6).

3. An apparatus according to claim 1, characterized by the apparatus comprising also one central pipe (22) aimed to collect and evacuate from the apparatus body (1) the solid elements, present in the fibrous suspension and retained by the filtration grate (6), which migrate to the centre the apparatus.

4. An apparatus according to claim 1, characterized by the separation cones of the clarification chamber (16) being prolonged in their peripheral part by channels (17) for the evacuation of separated particles having a density higher than 1, these channels communicating with a pipe (18) ending in a concentration chamber (19), at the periphery of the clarification chamber (16).

5. An apparatus according to claim 1, characterized by the separations cones of the clarification chamber (16) being prolonged in the direction of the apparatus axis by channels (36) for the evacuation of separated particles having a density lower than 1, these channels ending in a central pipe (37) for the evacuation of the separated particles.

6. An apparatus according to claim 1, characterized by the clarification chamber (16) being divided in two chambers functioning in series, both equipped with cones and separated by a central conical wall (35).

7. An apparatus according to claim 1, characterized by the body (1) of the apparatus also comprising a device for the recovery of cellulosic particles having passed through the filtration grate (6), said device being constituted by:

a sedimentation chamber (5), immediately downstream the filtration grate (6) and at its periphery, where the major part of the heavy contaminants and cellulosic particles having passed through the filtration grate (6) sediment, under the effect of the artificial gravity field created by the rotation of the apparatus;

a pipe (10), whose connection is located at the level of the sedimentation chamber (5) and which is oriented to the apparatus body centre (1), collecting the particles and contaminants that have there been sedimented, and dimensioned so that the flow speed in this pipe be higher than the speed of migration of the cellulosic particles to the periphery, while the heavier contaminants sediment at the periphery of said pipe (10);

a central pipe (14) collecting, near the axis of the apparatus, the flows of the pipe (10), mentioned at the previous paragraph and allowing their evacuation from the apparatus body (1) by its axis.

8. An apparatus according to claim 1, characterized by the apparatus comprising an inlet pipe (13), which allows the introduction into the fibrous suspension, at the inside of the apparatus body (1), solid elements in points (13*b*) located upstream the filtration grate (6) and at the periphery of the feeding zone (4) of said grate (6).

9. An apparatus according to claim 8, characterized by the filtration grate (6) being equipped with apertures of smaller dimension in the most peripheral part.

10. An apparatus according to claim 1, characterized by the body (1) of the apparatus comprising apertures (34), at the periphery of the preclarification chamber (33), to evacuate from the apparatus body (1) the solid elements which sediment at the periphery of said chamber (33).

11. An apparatus according to claim 1, characterized by the body (1) of the apparatus comprising inclined deflectors (39), fixed or adjustable, ensuring a communication between the periphery of the preclarification chamber (33) and the concentration chamber (7) of the suspension portion retained by the filtration grate (6).

12. An apparatus for the preparation of paper pulp from used papers previously disintegrated and put in fibrous suspension by a pulper, said apparatus comprising a body (1) rotating at high speed driving together all components inside it, the body (1) comprising:

an inlet pipe (2) for the fibrous suspension located at the centre of the body (1), being the fibrous suspension driven at the angular speed of the body by means of blades (3) solidary with the body (1);

a feeding zone (4) of a filtration grate (6) into which the fibrous suspension introduced in the body (1) of the apparatus is driven, being the grate (6) provided with small holes which allow to retain at least a part of the fibres contained in the suspension while the major part of the water, small contaminants and mineral loads contained in the suspension pass through the grate (6);

a zone (7) for the concentration of the part of the suspension retained by the grate (6) located at the periphery of the feeding zone (4) of the grate (6);

several apertures (8) located at the periphery of the body (1) of the apparatus to evacuate the concentrated suspension from the concentration zone (7); and a clarification chamber (16) to clarify the water having passed through the grate (6), the clarification chamber (16) including apertures (20) located at the periphery of the apparatus body (1) for the evacuation of the solid elements having sedimented at the periphery of said chamber (16) and a central pipe (21) for the evacuation of the clarified water; and a sedimentation device upstream the filtration grate (6), in order to make a separation of some contaminants with big dimensions contained in the fibrous suspension introduced in the apparatus, said device being constituted by: a sedimentation chamber (25); a hole (22*b*) located in the part closer to the axis of the sedimentation chamber (25), aimed to separate the light elements which there concentrate and driving them to the central pipe (22) and allowing their elimination; a hole (26) located at the periphery of the sedimentation chamber (25), aimed to separate the heavy elements, including cellulose fibres, which there sediment; a pipe (27) deriving the part of the fibrous suspension having passed into the chamber (25) and having not been separated by the holes (22*b*) and (26) of separation of light and heavy elements, into the feeding zone (4) of the filtration grate (6), or to the following stage of the method, if a complementary device is located between the sedimentation device and the filtration grate feeding zone; said pipe (27) having an inclination and section adapted so that the cellulosic elements are driven by the flow without sedimenting there; a pipe connecting the hole (26) for the separation of heavy elements to the pipe mentioned in the previous paragraph; a hole (30) for the elimination of heavy elements, in the peripheral part of the pipe (27) mentioned at paragraph d), aimed to collect and separate the heavier contaminants which sediment at the periphery of said pipe (27); and a pipe leading the solid elements captured by hole (30) for the elimination of the heavy elements mentioned at paragraph f) to the apertures (38), located at the periphery of the body (1), for the evacuation of the elements collected by said hole (30).

13. An apparatus for the preparation of paper pulp from used papers previously disintegrated and put in fibrous suspension by a pulper, said apparatus comprising a body (1) rotating at high speed driving together all components inside it, the body (1) comprising:

an inlet pipe (2) for the fibrous suspension located at the centre of the body (1), being the fibrous suspension driven at the angular speed of the body by means of blades (3) solidary with the body (1);

a feeding zone (4) of a filtration grate (6) into which the fibrous suspension introduced in the body (1) of the apparatus is driven, being the grate (6) provided with small holes which allow to retain at least a part of the fibres contained in the suspension while the major part of the water, small contaminants and mineral loads contained in the suspension pass through the grate (6);

a zone (7) for the concentration of the part of the suspension retained by the grate (6) located at the periphery of the feeding zone (4) of the grate (6);

several apertures (8) located at the periphery of the body (1) of the apparatus to evacuate the concentrated suspension from the concentration zone (7); and a clarification chamber (16) to clarify the water having passed through the grate (6), the clarification chamber (16) including apertures (20) located at the periphery of the apparatus body (1) for the evacuation of the solid elements having sedimented at the periphery of said chamber (16) and a central pipe (21) for the evacuation of the clarified water; and a classifier device upstream the filtration grate (6), aimed to separate the contaminants having a dimension higher than the cellulose fibres, said apparatus being constituted by: a classifier grate (23) having a flat or conical shape and having calibrated slots or holes such that the majority of the cellulose fibres pass through the slots and/or holes; apertures (38) located at the periphery of the apparatus body (1) and upstream the classifier grate (23), allowing to evacuate the elements, which do not pass through the slots and/or holes and migrate to the periphery of said grate (23); a central pipe (22) aimed to collect and evacuate from the apparatus body (1) the elements, which do not pass through the slots and/or holes, and migrate to the axis of the apparatus; and a pipe (24) leading the water and the elements having passed the classifier grate (23) to the feeding zone (4) of the filtration grate (6).

14. An apparatus according to claim 13, characterized by the apparatus body (1) comprising a device for the derivation of a part of the water, upstream the classifier grate (23), said apparatus being constituted by:

a water inlet (29) having a conical shape and oriented perpendicularly to the trajectories of the particles, located at the periphery and upstream the classifier grate (23); and a pipe connecting the water inlet mentioned at the previous paragraph and the clarification chamber or the feeding zone (4) of the filtration grate (6), according to the uses.

15. An apparatus according to claim 13, characterized by the classifier grate (23) being conical and including one or several inclinations (28) in order to avoid the accumulation of solid elements along the classifier grate (23).

16. An apparatus according to claim 13, characterized by the holes (40) of the classifier grate (23) having a radial direction and an entrance with the shape of a funnel, the entrances with the funnel shape of two adjacent holes joining themselves at the side upstream the grate in order to avoid any plane surface between two holes, and this being done to facilitate the orientation and the passage of the fibres.

17. An apparatus according to claim 13, characterized by the holes (40) of the classifier grate (23) being comprised by an inlet funnel and an outlet funnel in order to facilitate the passage of the fibres and avoid the risk of clogging.

18. An apparatus according to claim 1, characterized by the holes of the filtration grate (6) being calibrated to allow the passage of an important part of the short cellulose fibres and retain the majority of the long cellulose fibres, performing therefore a fractioning between short fibres and long fibres.

19. An apparatus according to claim 1, characterized by the apparatus comprising a central pipe aimed to lead directly to the inside of the apparatus body (1), at the level of the clarification chamber, some non-thickened semi-liquid effluents such as the foams of a de-inking cell.

* * * * *